US007915877B2

(12) United States Patent
Meier et al.

(10) Patent No.: US 7,915,877 B2
(45) Date of Patent: Mar. 29, 2011

(54) POWER SUPPLY CIRCUIT

(75) Inventors: Bernd Meier, Postbauer-Heng (DE); Peter Völkl, Wenzenbach (DE)

(73) Assignee: Continental Automotive GmbH, Hannover (DE)

( * ) Notice: Subject to any disclaimer, the term of this patent is extended or adjusted under 35 U.S.C. 154(b) by 1785 days.

(21) Appl. No.: 10/964,111

(22) Filed: Oct. 13, 2004

(65) Prior Publication Data

US 2005/0046403 A1 Mar. 3, 2005

Related U.S. Application Data

(63) Continuation of application No. PCT/DE03/01496, filed on May 9, 2003.

(30) Foreign Application Priority Data

May 16, 2002 (DE) ..... 102 21 889

(51) Int. Cl.
*G05F 1/577* (2006.01)

(52) U.S. Cl. ..... 323/267

(58) Field of Classification Search ..... 323/266, 323/267, 282, 351; 307/31
See application file for complete search history.

(56) References Cited

U.S. PATENT DOCUMENTS

| | | | | |
|---|---|---|---|---|
| 4,292,584 A | | 9/1981 | Kusakabe | 323/316 |
| 4,644,251 A | | 2/1987 | Rathke | 323/267 |
| 5,412,308 A | * | 5/1995 | Brown | 323/267 |
| 5,814,977 A | | 9/1998 | Kim | 323/267 |
| 5,907,482 A | | 5/1999 | Otake | 363/41 |
| 5,995,389 A | | 11/1999 | Otake | 363/39 |
| 5,995,390 A | * | 11/1999 | Otake | 363/39 |
| 6,172,494 B1 | | 1/2001 | Feuser | 323/288 |
| 6,522,110 B1 | * | 2/2003 | Ivanov | 323/267 |

FOREIGN PATENT DOCUMENTS

| | | |
|---|---|---|
| GB | 946213 | 1/1964 |
| JP | 58 224 562 A | 12/1983 |

OTHER PUBLICATIONS

International Provisional Examination Report for International Patent Application No. PCT/DE03/01496 (6 pages), Apr. 1, 2004.

* cited by examiner

*Primary Examiner* — Adolf Berhane
(74) *Attorney, Agent, or Firm* — King & Spalding L.L.P.

(57) ABSTRACT

A power supply circuit (1), particularly for a microcontroller of a transmission control unit, comprises a first output (3) supplying a first output voltage ($U_{OUT1}$) and a second output (4) supplying a second output voltage ($U_{OUT2}$), the first output voltage ($U_{OUT1}$) being different from the second output voltage ($U_{OUT2}$). The power supply circuit (1) also comprises a unit (OP1, T2, OP2, T3) adjusting the first ($U_{OUT1}$) and second output voltage ($U_{OUT2}$) and a controller (OP3-OP5, T2, T3) limiting the voltage difference between the first ($U_{OUT1}$) and second output voltage ($U_{OUT2}$).

19 Claims, 2 Drawing Sheets

POWER SUPPLY CIRCUIT

CROSS REFERENCE TO RELATED APPLICATION

This application is a continuation of copending International Application No. PCT/DE03/01496 filed May 9, 2003 which designates the United States, and claims priority to German application no. 102 21 889.7 filed May 16, 2002.

TECHNICAL FIELD OF THE INVENTION

The invention relates to a power supply circuit, especially for a microcontroller of a transmission control unit.

DESCRIPTION OF THE RELATED ART

Modern microcontrollers mostly need two different supply voltages of for example 5 Volts and 3.3 Volts, where the two supply voltages may only vary between two prespecified bandwidths in order not to adversely affect the functional capabilities of the microcontroller. Under no circumstances may the voltage difference between the two supply voltages exceed or fall below the maximum permissible values stated in the data sheet of the relevant microcontroller. This is especially critical after switch-on and during power down during the switch-off phase since then different load currents flow and furthermore different load capacities can be used.

Power supply circuits are therefore known in which the two supply voltages are each regulated by a linear regulator in order to avoid power variations.

The disadvantage of this is however that the regulation variations of the two supply voltages are regulated out separately so that the regulation for greatly different load currents at the two outputs is not sufficient under some circumstances to adhere to the specified voltage difference.

Further it is known that the two outputs of these types of power supply circuits can be connected with Zener diodes or Power Schottky diodes, to keep the voltage different between the two supply voltages within the permitted bandwidth. The voltage difference between the two supply voltage can then only rise until the breakdown voltage of the Zener diode is reached.

The disadvantage of this type of power supply circuit is the relatively high expense associated with the use of Zener diodes or Power Schottky diodes.

SUMMARY OF THE INVENTION

The object of the invention is therefore to create a power supply circuit with two different output voltages, where the voltage difference between the two output voltages can be kept within the permitted bandwidth with as little effort as possible.

The object can be achieved by a power supply circuit, especially for a microcontroller of a transmission control, comprising a first output to provide a first output voltage, a second output to provide a second output voltage, wherein the first output voltage and the second output voltage being different, an adjusting unit for setting the first output voltage and the second output voltage, and a first regulator for limiting the voltage difference between the first output voltage and the second output voltage by regulating the voltage difference between the first and second output voltages.

The object can also be achieved by a power supply circuit, especially for a microcontroller of a transmission control, comprising a first voltage control circuit for providing a first output voltage at a first output, a second voltage control circuit for providing a second output voltage at a second output, wherein the first output voltage and the second output voltage being different, and a comparator coupled with the first and second output voltage and with the first and second control circuit for limiting the voltage difference between the first output voltage and the second output voltage by controlling the first and second voltage control circuits to regulate the voltage difference between the first and second output voltages.

The first regulator can be connected on the input side to the first output and the second output and on the output side to the adjusting unit. The first regulator may comprise a comparator with a first input and a second input, with the first input of the comparator being connected to the first output while the second input of the comparator is connected to the second output. For low-resistance connection of the first output to the second output at least one controllable switching element can be provided, with the comparator being connected on the output side with the switching element. The adjusting unit for setting the first output voltage may comprise a first switching element and for setting the second output voltage a second switching element, in which case the first switching element and the second element are connected in series between the first output and the second output and are connected to the comparator for activation. The first regulator may comprise two comparators which, to record the voltage difference are each connected on the input side with the first output and the second output. At least one of the two comparators of the first regulator can be connected via a reference voltage element with the first output or the second output. The adjusting unit may comprise a second regulator to regulate the first output voltage and a third regulator to regulate the second output voltage. The second regulator and/or the third regulator can be connected on the input side with a reference voltage element. The reference voltage element may comprise a variable output voltage which corresponds to a prespecified voltage time line. The first output and/or the second output can be connected to an output capacitor, in which case to discharge the output capacitor, a short circuit switch is provided. To provide an internal control voltage a charge pump circuit can be provided.

The invention includes the general technical disclosure of regulating the voltage difference between the two output voltages to prevent the permitted voltage difference being exceeded, whereas with the known power supply circuits the two output voltages are regulated separately from each other.

The power supply circuit in accordance with the invention therefore features a regulator which regulates the voltage difference between the two output voltages to a prespecified value.

Preferably to control the voltage difference the regulator is connected on the input side with the two outputs of the power supply circuit and on the output side with a unit which adjusts the two output voltages, via which a feedback loop is formed.

The adjusting unit can for example feature two conventional linear regulators which regulate the two output voltages according to a specified required value separately from one another. In this case the regulation loop for regulating the voltage difference preferably overlays the two separate regulation loops for regulating the two output voltages.

In a simple embodiment of the inventive power supply circuit the two output voltages are adjusted instead without any feedback by a control, with the regulator for regulating the voltage difference specifying the control variable. Thus the regulating loop for regulating the voltage difference in this case overlays the voltage difference for adjusting the two output voltages.

In a variant of the invention the regulator for regulating the voltage difference features a comparator, in which case the two inputs of the comparator are connected to the two outputs of the power supply circuit, so that the comparator measures the voltage difference between the two output voltages.

A variant of the invention provides for at least one switching element which allows a low-resistance connection of the two outputs of the power supply circuit to reduce or limit the voltage difference between the two outputs.

A separate switching element can be used for this, arranged between the two outputs of the power supply circuit and connecting these together at low resistance to limit the voltage difference.

Preferably for the low-resistance connection of the two outputs of the power supply circuit however two switching elements are employed which are used for separate regulation of the two output voltages.

Thus the two output voltages are usually provided by one output capacitor in each case, with the two output capacitors being charged via one switching element each by an input voltage. Through switching of the two switching elements leads in this case to a low-resistance connection between the two outputs of the power supply circuit, which leads to a synchronization.

In a variant of the invention the regulator for regulating the voltage difference features two comparators which are each connected on the input side with the two outputs of the power supply circuit. One of the two inputs of the comparators in this case is connected via a reference voltage element to the relevant output of the power supply circuit, in which case the two reference voltage elements specify the maximum voltage difference in the positive of the negative direction. One comparator thus indicates whether the voltage difference between the two output voltages is exceeding the permitted bandwidth upwards. The other comparator specifies conversely whether the voltage difference between the two output voltages is exceeding the permitted bandwidth downwards.

BRIEF DESCRIPTION OF THE DRAWINGS

Other advantageous developments of the invention are identified in the subclaims or are explained in greater detail below together with the description of the preferred exemplary embodiment of the invention on the basis of the figures. The figures show:

DETAILED DESCRIPTION OF THE PREFERRED EMBODIMENTS

Figure 1:
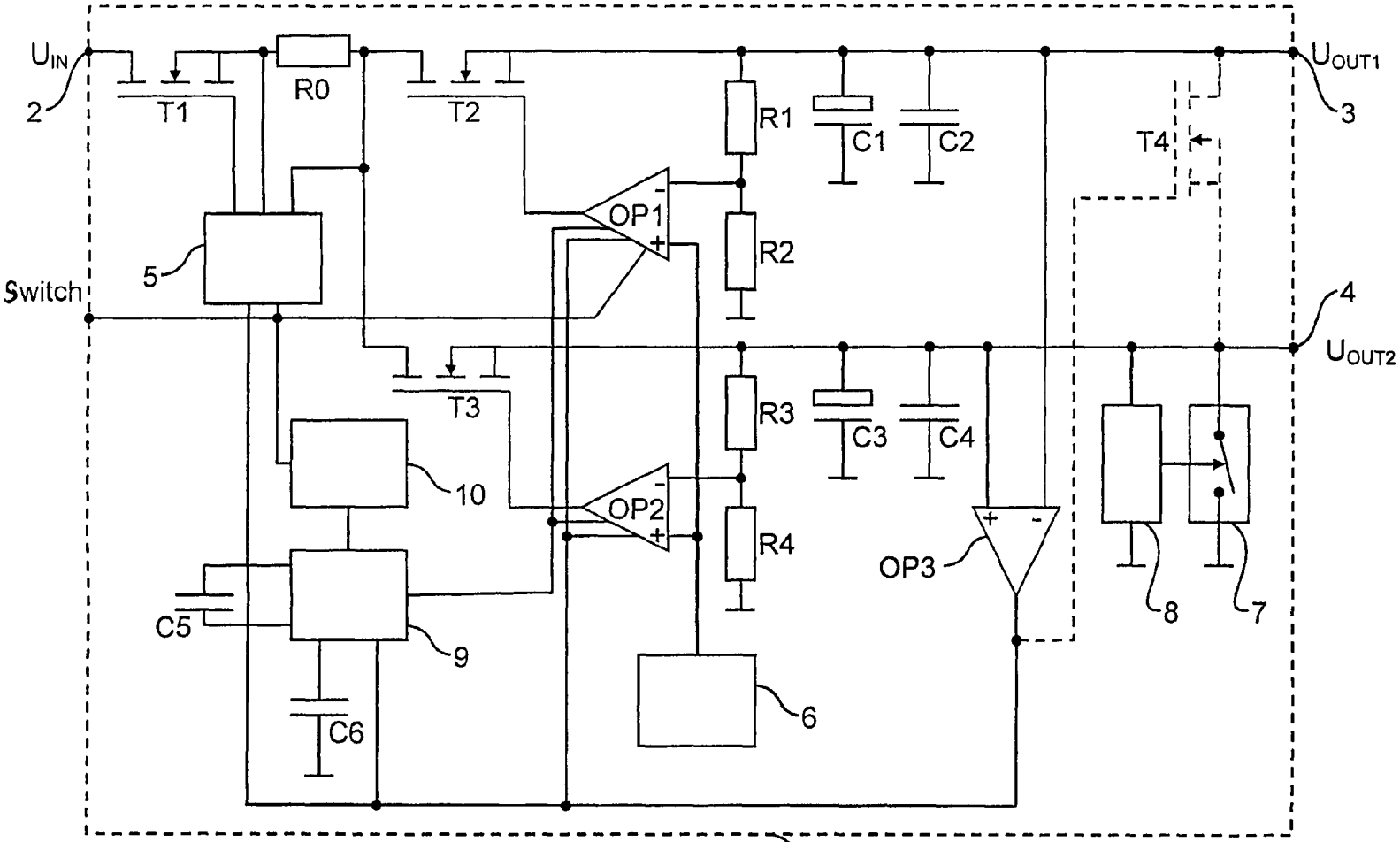
FIG. 1 a power supply circuit in accordance with the invention in the form of a circuit diagram as well as FIG. 2 an alternate embodiment of a power supply circuit in accordance with the invention.

The block diagram shown in FIG. 1 illustrates a power supply circuit 1 in accordance with the invention which is supplied via an input 2 with an input voltage $U_{IN}$ and features two outputs 3, 4, in which case at output 3 an output voltage $U_{OUT1}$=+5V is output, whereas at output 4 an output voltage $U_{OUT2}$=+3.3V is provided.

To stabilize the output voltage $U_{OUT1}$ the output 3 of the power supply circuit 1 is connected to ground by two output capacitors C1, C2.

Output 4 is also connected to ground by two output capacitors C3, C4 in order to stabilize the output voltage $U_{OUT2}$.

On the input side the power supply circuit 1 features a transistor T1 which is activated by a pre-regulator 5, where one of the tasks of the pre-regulator 5 is to limit the current.

To measure the current the transistor T1 is connected in series with a measurement resistor R0, in which case the pre-regulator 5 measures the voltage drop across the measuring resistor R0 and blocks the transistor T1 if the current through the measuring resistor R0 rises disproportionately.

On the output side the measuring resistor is connected via a transistor T2 with the output 3 and via a transistor T3 with the output 4 of the power supply circuit.

If the two transistors T1 and T2 become conductive, the two output capacitors C1, C2 can be changed via the input voltage $U_{IN}$ which leads to an increase in the output voltage $U_{OUT1}$. A blocking of the transistor T2 on the other hand leads to load-dependent discharging of output capacitors C1, C2, which causes output voltage $U_{OUT1}$ to drop.

Accordingly the two output capacitors C3, C4 can be charged if the two transistors T1 and T3 conduct, which leads to a rise in the output voltage $U_{OUT2}$. If on the other hand the transistor T3 blocks, the output capacitors C3, C4 are discharged depending on the electrical load connected at output 4, which leads to a drop in the output voltage $U_{OUT2}$.

Both the output voltage $U_{OUT1}$ and also the output voltage $U_{OUT2}$ are regulated in this case by a regulator, with the required value of the relevant output voltage $U_{OUT1}$ or $U_{OUT2}$ being specified by a reference voltage element 6.

The regulator for the output voltage $U_{OUT1}$ features a comparator OP1 which on the input side compares the output voltage $U_{OUT1}$ with the specified required value and, depending on the regulation deviation, activates the transistor T2 to regulate the output voltage $U_{OUT1}$ to the prespecified required value.

To record the output voltage $U_{OUT1}$ a voltage divider is provided consisting of two resistors R1, R2 which are connected in series between output 3 of the power supply circuit 1 and ground. The center tap of the voltage divider between the two resistors R1, R2 is connected to the inverting input of comparator OP1, while the non-inverting input of comparator OP1 is connected to the reference voltage element 6. A fall in output voltage $U_{OUT1}$ to below the required value specified by the reference voltage element 6 thus leads to the comparator OP1 activating transistor T2, so that the output capacitors C1, C2 can be charged. A rise in the output voltage $U_{OUT1}$ to above the required value specified by the reference voltage element 6 leads on the other hand to the comparator OP1 blocking the transistor T2, so that the output capacitors C1, C2 are no longer charged, which leads to a load-dependent fall in output voltage $U_{OUT1}$.

In the same way the regulator for the output voltage $U_{OUT2}$ features a comparator OP2 which compares the output voltage $U_{OUT2}$ with a specified required value and activates the transistor T2 accordingly, to regulate the output voltage $U_{OUT2}$ to the specified required value.

To measure the output voltage $U_{OUT2}$, a voltage divider consisting of two resistors R3, R4 is also provided which are connected between the output 4 of power supply circuit 1 and ground. The center tap between the two resisters R3, R4 is connected to the inverting input of comparator OP2, while the non-inverting input of comparator OP2 is connected to the reference voltage element 6. A fall in the output voltage $U_{OUT2}$ to below the required values specified by the reference voltage element 6 thus leads to the comparator OP2 activating the transistor T2, so that the output capacitors C3, C4 can be charged. An increase in the output voltage $U_{OUT2}$ to above the required value specified by the reference voltage element 6 leads to the comparator OP2 blocking the transistor T2, so that the output capacitors C3, C4 are no longer charged, which leads to a load-dependent fall in the output voltage $U_{OUT2}$.

The required values for the output voltages $U_{OUT1}$ and $U_{OUT2}$ are however not the same but can be determined by its suitable dimensioning of the resistors R1, R2 or R3, R4.

Furthermore the power supply circuit 1 in accordance with the invention features in regulation loop to limit the voltage difference between the output voltage $U_{OUT1}$ and the output voltage $U_{OUT2}$.

To measure this voltage difference a comparator OP3 is provided, in which case the inverting input of the comparator OP3 is connected to output 3 of the power supply circuit, while the non-inverting input of the comparator OP3 is connected to the output 4 of power supply circuit 1.

On the output side the comparator OP3 is connected to the two comparators OP1 and OP2 so that the comparator OP3 indirectly activates the two transistors T2 and T3. If the output voltage $U_{OUT1}$ falls below the output voltage $U_{OUT2}$, the comparator OP3 activates the two comparators OP1 and OP2 so that the two transistors T2 and T3 switch. In this case the output 3 will be short-circuited via the output 4 via the two transistors T2 and T3, which forces a synchronization of the two output voltages $U_{OUT1}$ and $U_{OUT2}$. If on the other hand the output voltage $U_{OUT1}$ is above the output voltage $U_{OUT2}$, the comparator OP3 has no influence on the two comparators OP1 and OP2.

In an alternative shown by dashed lines the power supply circuit 1 features a transistor T4 which is connected between the output 3 and the output 4 and is activated by the comparator OP3. The comparator OP3 switches transistor T4 if the output voltage $U_{OUT1}$ falls below the output voltage $U_{OUT2}$ which forces a synchronization of the output voltages $U_{OUT1}$ and $U_{OUT2}$. If the output voltage $U_{OUT1}$ lies above the output voltage $U_{OUT2}$ on the other hand, in this alternative the comparator OP3 blocks the transistor T4, so that the output voltages $U_{OUT1}$ and $U_{OUT2}$ are regulated by the two comparators OP1 and OP2 to their relevant required values.

In addition the power supply circuit 1 features a controllable switching element 7 which connects the output 4 to ground and thereby enables the output voltage $U_{OUT2}$ to be short-circuited to ground. In this way the two output capacitors C3, C4 can be completely discharged in order to establish a defined initial status for the next start up after the switch-off process. In addition a through switching of the switching element 7 also leads to a discharging of the output capacitors C1, C2 if the two transistors T2, T3 through switch simultaneously or if the transistor T4 conducts.

The switching element 7 is activated here by a control unit 8 which is connected with the output 4 and compares the output voltage $U_{OUT2}$ with a prespecified limit value. If this limit value is undershot the control unit 8 then switches switching element 7 so that the output capacitors C3, C4 or C1, C2 are fully discharged at the end of a switch-off phase.

Further the power supply circuit 1 features a conventional charge pump circuit 9 which pumps the electrical energy stored in a pump capacitor C5 several times into a buffer capacitor C6, so that the output voltage of the charge pump current 9 rises via the input voltage $U_{IN}$. The charge pump circuit 9 is activated by a conventional charge pump oscillator 10.

The switch-on process of the power supply circuit 1 described here is now explained.

In this case the reference voltage element 6 specifies a continuously rising required value for the output voltages $U_{OUT1}$ or $U_{OUT2}$, in which case the voltage rises so slowly that the two regulators for the output voltage $U_{OUT1}$ or $U_{OUT2}$ are able, even with a different loading of outputs 3, 4, to regulate the output voltages $U_{OUT1}$, $U_{OUT2}$ without any great deviation in regulation to the relevant required value. The slow startup of the required value for the output voltages $U_{OUT1}$, $U_{OUT2}$ thus prevents the voltage difference between the output voltages $U_{OUT1}$, $U_{OUT1}$ leaving the allowed range.

The switch-off process of the power supply circuit 1 described here, which can be initiated in different ways is now explained.

One possibility for initiating the switch-off process consists of applying a switch-off signal to the control input Switch which is connected to the comparator OP1. The switch-off signal then leads to the comparator OP1 blocking the transistor T2.

In addition the switch-off process can also be initiated by the pre-regulator 5, when the input voltage $U_{IN}$ is switched off. The pre-regulator 5 is therefore also connected to comparator OP1 and controls this at the beginning of the switch-off process so that the transistor T2 blocks.

The blocking of the transistor T2 initially leads to a load-dependent discharge of the output capacitors C1, C2 via the output 3 and thereby to a fall in the output voltage $U_{OUT1}$ which at the beginning of the switch-off process is greater than the output voltage $U_{OUT2}$.

The output voltage $U_{OUT2}$ by contrast is initially still kept to its required value by the comparator OP2, until the output voltage $U_{OUT1}$ than falls as a result of the discharging of the output capacitor C1, C2 below the output voltage $U_{OUT2}$.

As soon as the output voltage $U_{OUT1}$ has fallen to the output voltage $U_{OUT2}$ the synchronization function is activated by the comparator OP3 activating the two comparators OP1, OP2 so that these switch through the two transistors T2, T3. In this state the output 3 is short circuited via the two transistors T2 and T3 with the output 4 of the power supply circuit, so that a synchronization of the two output voltages $U_{OUT1}$, $U_{OUT2}$ is forced.

In addition the comparator OP3 also controls the pre-regulator 5 at this point so that this disconnects the transistor T1, so that a complete shutdown of the two output voltages $U_{OUT1}$ and $U_{OUT2}$ is made possible.

The two output voltages $U_{OUT1}$ and $U_{OUT2}$ then fall synchronously until a lower limit value specified by the control unit 8 is exceeded, at which point the control unit 8 switches the switch element 7 so that the output capacitors C1, C2 and C3, C4 are finally short circuited to ground, which leads to a complete discharging of output capacitors C1-C4.

On the one hand the short circuit of the output capacitors C1-C4 via the switching element 7 shortens the switch-off process.

On the other hand the complete discharging of the output capacitors C1-C4 at the end of a switch-off process leads to a defined initial state for the next start up.

The electrical energy required for the switch off process is provided by the charging pump circuit 9 if the input voltage $U_{IN}$ has been switched off. In such a case the pre-regulator 5 switches off the charge pump oscillator 10 in order to save energy during the switch-off process.

The alternative embodiment shown in FIG. 2 of a power supply circuit 1 in accordance with the invention largely matches the power supply circuit described above and shown in FIG. 1, so that to avoid any repetitions below reference is made largely to the existing description.

Figure 2:
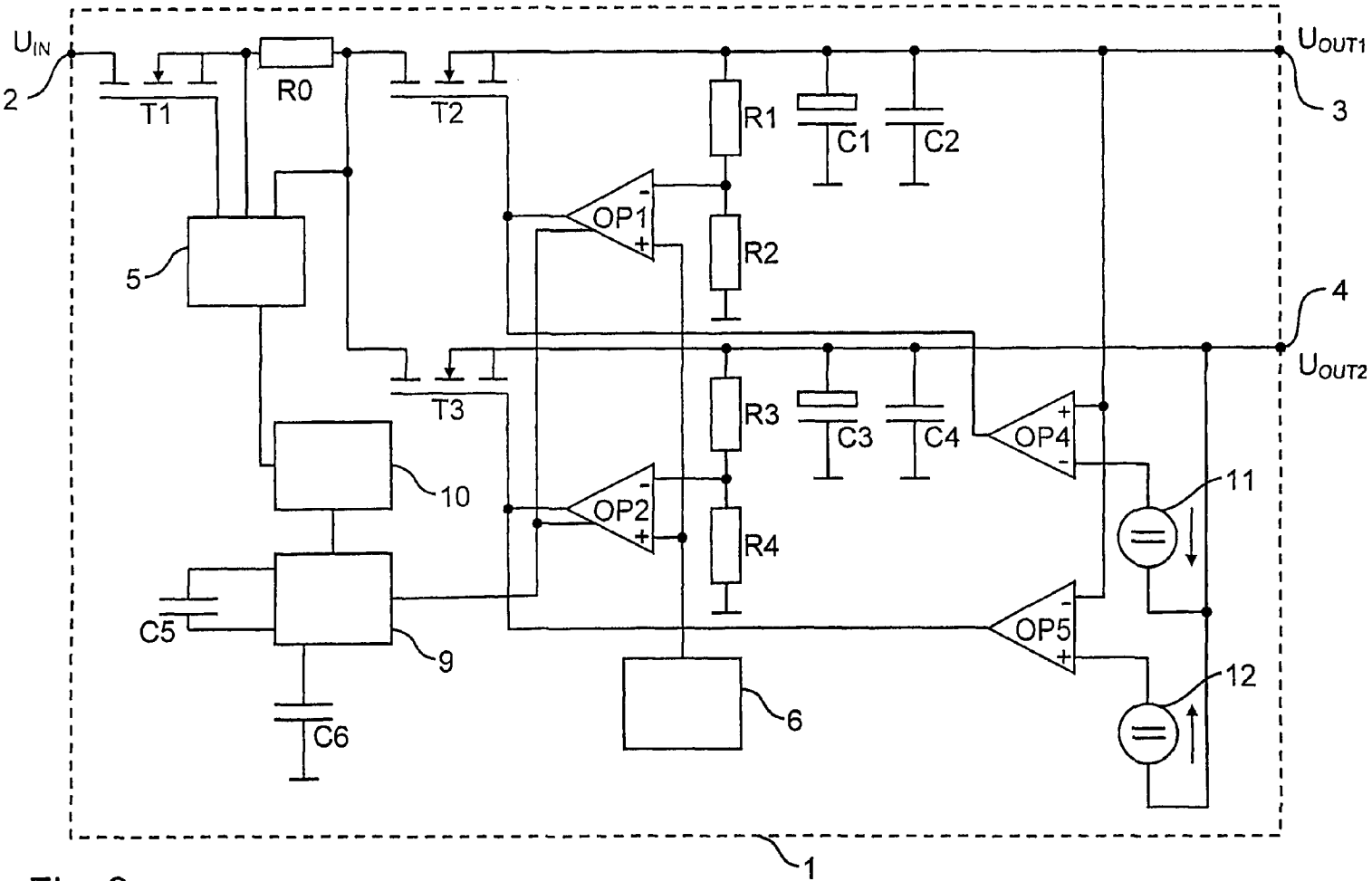

In addition components in FIGS. 1 and 2 which correspond are given the same reference symbols to make assignment easier.

A special feature of this exemplary embodiment is in the regulation of the voltage difference between the two output voltages $U_{OUT1}$ and $U_{OUT2}$. To this end the power supply circuit 1 features two comparators OP4 and OP5 which check whether the voltage difference between the two output voltages $U_{OUT1}$ and $U_{OUT2}$ leaves the permitted range.

In this case comparator OP4 checks whether the voltage difference between the two output voltages $U_{OUT1}$, $U_{OUT2}$ becomes too large. To this end the non-inverting input of the comparator OP4 is connected to output 3 while the inverting input of the comparator OP4 is connected via a reference voltage element 11 with the output 4. The reference voltage element 11 in this case delivers a reference voltage $U_{REF1}$ which corresponds to the maximum allowed voltage difference between the two output voltages $U_{OUT1}$, $U_{OUT2}$. On the output side the comparator OP4 is connected to the transistor T2 to regulate the voltage difference between the two output voltages $U_{OUT1}$ and $U_{OUT2}$. The comparator OP4 thus checks the following voltage condition:

$$U_{OUT1}>U_{OUT2}+U_{REF1}.$$

If this voltage condition is fulfilled the comparator OP4 blocks the transistor T2 so that the output voltage $U_{OUT1}$ does not rise any further. This ensures that the maximum permitted voltage difference $U_{OUT1}$-$U_{OUT2}$ remains between the two output voltages within the limit values specified by the reference voltage.

The comparator OP5 on the other hand is designed to prevent the minimum allowed voltage difference between the two output voltages $U_{OUT1}$, $U_{OUT2}$ being exceeded. To this end the inverting input of the comparators OP5 is connected to the output 3, while the non-inverting input of the comparator OP5 is connected via a reference voltage element 12 with the output 4. The reference voltage element 12 in this case delivers the reference voltage $U_{REF2}$ which corresponds to the minimum permitted voltage difference between the output voltages $U_{OUT1}$, $U_{OUT2}$. On the output side the comparator OP5 is connected to the transistor T3 so that the output voltage $U_{OUT2}$ is regulated depending on the measured voltage difference. In this case the comparator OP5 checks the following voltage condition:

$$U_{OUT1}<U_{OUT2}+U_{REF2}.$$

If this condition is fulfilled the comparator OP5 blocks the transistor T3, so that the output voltage $U_{OUT2}$ cannot rise any further. This guarantees that the voltage difference between the two output voltages $U_{OUT1}$-$U_{OUT2}$ remains within the limits specified by the reference voltage.

The invention is not restricted to the preferred exemplary embodiments described here. Instead numerous variants and variations are conceivable, which also make use of the inventive idea and therefore come within the protected area.

We claim:

1. A power supply circuit, especially for a microcontroller of a transmission control, comprising:

a first output to provide a first output voltage, a second output to provide a second output voltage, wherein the first output voltage and the second output voltage being different, an adjusting unit for setting the first output voltage and the second output voltage, and a first regulator for limiting the voltage difference between the first output voltage and the second output voltage by regulating the voltage difference between the first and second output voltages.

2. The power supply circuit according to claim 1, wherein, the first regulator is connected on the input side to the first output and the second output and on the output side to the adjusting unit.

3. The power supply circuit according to claim 1, wherein, the first regulator comprises a comparator with a first input and a second input, with the first input of the comparator being connected to the first output while the second input of the comparator is connected to the second output.

4. The power supply circuit according to claim 1, wherein, the first regulator comprises two comparators which, to record the voltage difference are each connected on the input side with the first output and the second output.

5. The power supply circuit according to claim 4, wherein, at least one of the two comparators of the first regulator is connected via a reference voltage element with the first output or the second output.

6. The power supply circuit according to claim 1, wherein, the adjusting unit comprises a second regulator to regulate the first output voltage and a third regulator to regulate the second output voltage.

7. The power supply circuit according to claim 6, wherein, the second regulator and/or the third regulator are connected on the input side with a reference voltage element.

8. The power supply circuit according to claim 7, wherein, the reference voltage element comprises a variable output voltage which corresponds to a prespecified voltage time line.

9. The power supply circuit according to claim 1, wherein, the first output and/or the second output is connected to an output capacitor, in which case to discharge the output capacitor, a short circuit switch is provided.

10. The power supply circuit according to claim 1, wherein, to provide an internal control voltage a charge pump circuit is provided.

11. A power supply circuit for a microcontroller of a transmission control, said circuit comprising:

a first output to provide a first output voltage;

a second output to provide a second output voltage, wherein the first output voltage and the second output voltage are different;

an adjusting unit for setting the first output voltage and the second output voltage;

a first regulator for limiting the voltage difference between the first output voltage and the second output voltage by regulating the voltage difference between the first and second output voltages;

wherein the first regulator comprises a comparator with a first input and a second input, with the first input of the comparator being connected to the first output while the second input of the comparator is connected to the second output; and for low-resistance connection of the first output to the second output at least one controllable switching element is provided, with the comparator being connected on the output side with the switching element.

12. The power supply circuit according to claim 11, wherein, the adjusting unit for setting the first output voltage comprises a first switching element and for setting the second output voltage a second switching element, in which case the first switching element and the second element are connected in series between the first output and the second output and are connected to the comparator for activation.

13. The power supply circuit according to claim 11, wherein the first regulator is connected on the input side to the first and second outputs and on the output side to the adjusting unit.

14. The power supply circuit according to claim 11, wherein the first regulator comprises a comparator with a first input and a second input, the first input of the comparator connected to the first output and the second input of the comparator connected to the second output.

15. A power supply circuit for a microcontroller of a transmission control, said circuit comprising:

a first voltage control circuit for providing a first output voltage at a first output, a second voltage control circuit for providing a second output voltage at a second output, wherein the first output voltage and the second output voltage differ, a comparator coupled with the first and second output voltage and with the first and second control circuit for limiting the voltage difference between the first output voltage and the second output voltage by controlling the first and second voltage control circuits to regulate the voltage difference between the first and second output voltages; and at least one controllable switching element for low-resistance connection of the first output to the second output, the comparator being connected on the output side with the switching element.

16. The power supply circuit according to claim 15, further comprising a second comparator coupled on the input side with the first output and the second output.

17. The power supply circuit according to claim 16, wherein, at least one of the two comparators is connected via a reference voltage element with the first output or the second output.

18. The power supply circuit according to claim 15, wherein, the first output and/or the second output is connected to an output capacitor, in which case to discharge the output capacitor, a short circuit switch is provided.

19. The power supply circuit according to claim 15, wherein, to provide an internal control voltage a charge pump circuit is provided.

* * * * *